United States Patent [19]

Hayashi

[11] Patent Number: 4,772,177

[45] Date of Patent: Sep. 20, 1988

[54] SCREW PUMP

[75] Inventor: Akira Hayashi, Tokushima, Japan

[73] Assignee: Hayashi Seiko Co. Ltd., Japan

[21] Appl. No.: 56,139

[22] Filed: May 29, 1987

[30] Foreign Application Priority Data

Jun. 20, 1986 [JP] Japan ..... 61-145600
Aug. 12, 1986 [JP] Japan ..... 61-190051

[51] Int. Cl.[4] ..... F04D 3/02
[52] U.S. Cl. ..... 415/74; 366/299
[58] Field of Search ..... 415/71, 72, 73, 74, 415/75; 366/80, 279, 292, 297, 299, 301

[56] References Cited

U.S. PATENT DOCUMENTS 3,423,782 1/1969 Klosel ..... 415/74
3,804,553 4/1974 Hickey, Jr. ..... 415/122 A

FOREIGN PATENT DOCUMENTS 320962 12/1902 France ..... 366/297
737653 6/1980 U.S.S.R. ..... 415/72
926357 5/1982 U.S.S.R. ..... 415/71

*Primary Examiner*—Robert E. Garrett
*Assistant Examiner*—John T. Kwon
*Attorney, Agent, or Firm*—Donald D. Mon

[57] ABSTRACT

This invention relates to a screw pump for feeding mixed concrete and the like, sticky material such as adhesive fluid without bitting and clogging and feeding them continuously and effectively. For preventing the bitting, a bearing is provided at the inlet of outer cylinder of the pump and inner sleeve of the bearing is fixed to the edge of screw. For preventing the clogging, a multiple of partition plates is inserted between the blade of the screw which can slide along the shaft of the screw.

5 Claims, 4 Drawing Sheets

SCREW PUMP

FIELD OF THE INVENTION

The present invention relates to a screw pump, more particularly to a pressure feeding screw pump being capable of feed ready mixed concrete and similar materials such as rice, wheat, beans, gravel, clay, viscous fluids such as starch syrup and glucose, and sticky materials such as malt and yeast.

BACKGROUND OF THE INVENTION

Conventional pressure feed pumps provided for feeding ready mixed concrete can be classified into:

1. Compressed air type,
2. Tube type, and
3. Plunger type.

These types of pressure feed pumps are all defective because of complicated structure, intermittent feed, and low efficiency.

On the other hand, a conventional screw pump having a revolving blade extending helically can feed fluid continuously and efficiently.

However, the conventional screw pump is defective in that when fed through, ready mixed concrete, adhesive fluids, or sticky materials clog in the revolving blade sections of the screw to turn together with the revolving blade in the outer cylinder; that is, the screw pump would not be capable of feeding the materials due to clogging. This results in clogging of the materials.

Moreover, the conventional screw pump is still deffective in that aggregate including stone, gravel, and the like are bit (clipped) in between an edge of the revolving blade thereof and the inside of the outer cylinder thereof. It has not been possible to use the conventional screw pump for feeding the ready mixed concrete and the like.

Therefore, it is an object of the present invention to provide a screw pump which can effectively and securely feed ready mixed concrete, gravel, clay, viscous fluids such as starch syrup and glucose, and sticky materials such as malt and yeast.

It is an another object of this invention to provide a pressure feed screw pump which can prevent the aggregate from being bit in between the outer cylinder and the revolving blade of the screw, and allows the ready mixed concrete to be fed by the screw continuously and effectively.

BRIEF DESCRIPTION OF THE INVENTION

The present invention provides a screw pump comprising an outer cylinder 1 having a longitudinal guide groove 3 extending axially on an inside thereof, a screw 2 provided to revolve in said outer cylinder 1 having a shaft 4 on axis thereof, and a plurality of partition plates 5 slidably movable in an axial direction of said outer cylinder and in contact with said shaft to block one revolving blade section, say 2*a*, of said screw from another, say 2*b*. By the present invention, the screw 2, when revolved by the shaft 4, presses the partition plates 5 to slide along with the longitudinal guide groove 3 in the axial direction of the shaft 4. The partition plates 5 can divide the space extending in a spiral in the screw 2, so that each partitioned space can move forward along with the rotation of the screw 2. Each of the partition plates 5 can scrape sticky material off the screw 2. The screw pump can be free of clogging, assuring secure feed of sticky materials.

The present invention provides a screw pump comprising a bearing 30 FIG. 4 at an inlet of said outer cylinder 1: the inner sleeve 31 of the bearing 30 is fixed to the edge of said screw 2 at a fixing position 32. This prevents the ready mixed concrete, the aggregate, or similar foreign materials from being caught between the screw and the outer cylinder 1.

The above and other features of this invention will be fully understood from the following detailed description and the drawings accompanied herewith.

BRIEF DESCRIPTION OF THE DRAWINGS

FIG. 1 (*b*) is a partially enlarged view of FIG. 1 (*a*).

FIG. 1 (*c*) is a transverse cross-sectional view of FIG. 1(*b*).

FIG. 3 (*b*) is a cross-sectional view taken along lines I—I and II—II of FIG. 3 (*a*).

FIG. 3 (*c*) is a cross-sectional view at a detent pertion of a partition plate.

DETAILED DESCRIPTION OF THE INVENTION

Figure 1A:
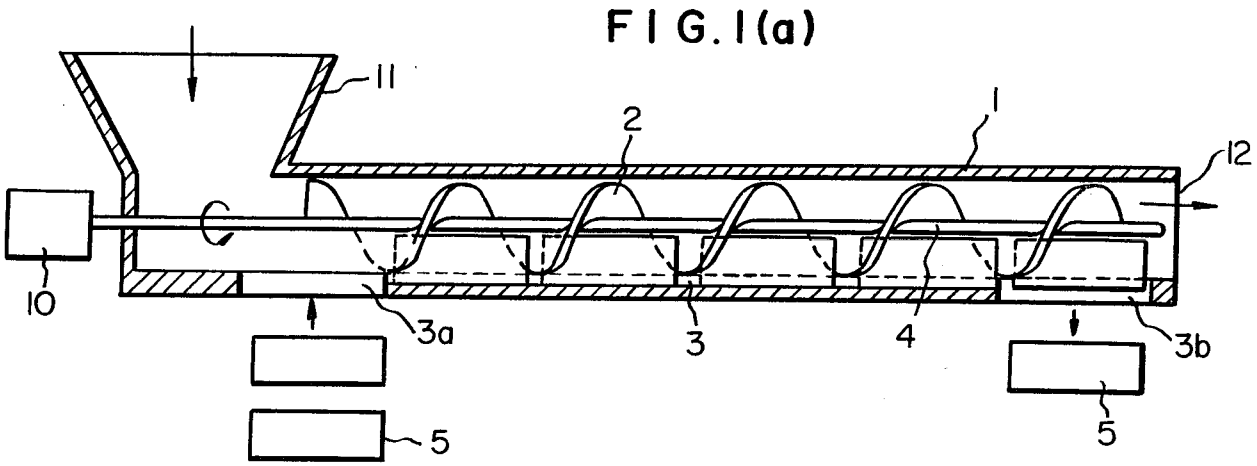
FIG. 1 (*a*) is a longitudinal cross-sectional view of a first embodiment of a screw pump according to the present invention.
Figure 1B:
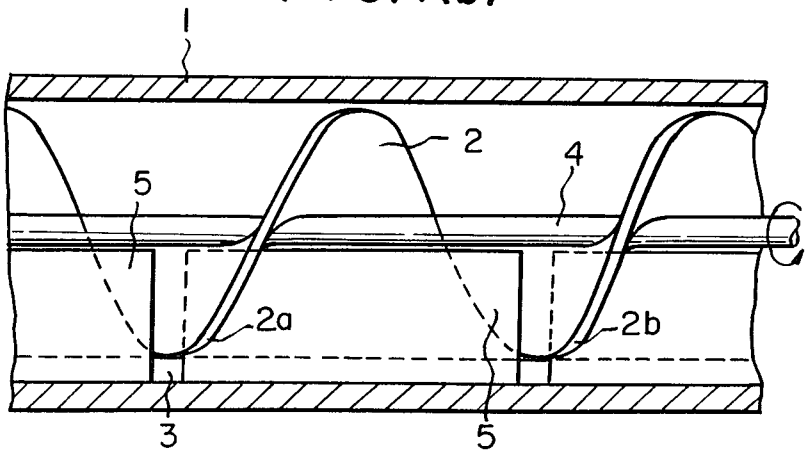
Figure 1C:
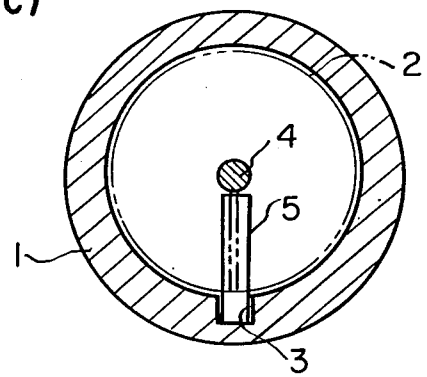

Referring to FIGS. 1(*a*), (*b*), and (*c*), the first embodiment of present invention provides a screw pump comprising an outer cylinder 1 having a longitudinal guide groove 3 extending axially on an inside thereof, a screw 2 provided to revolve in said outer cyliner 1 having a shaft 4 on axis thereof, and a plurality partition plates 5 slidably movable in an axial direction of said outer cylinder 1 and in contact with said shaft 4 to block one revolving blade section, say 2*a* of said screw from another, say 2*b*.

Referring to FIG. 1(*a*), the screw pump has a motor 10, an inlet hopper 11, and an outlet 12 provided in place. The screw pump also has a partition plate inlet hole 3*a* and a partition plate outlet hole 3*b* provided at an inlet edge of the longitudinal guide groove 3 and an outlet edge thereof, respectively. Each of the partition plates 5 that has exited the outlet hole 3*b* can be returned to the inlet hole 3*a*.

The partition plates 5 are not necessarily continuously arranged as shown. The partition plate 5 and the longitudinal guide groove 3 can be provided on a lower side of the outer cylinder 1 as though those were on an upper side thereof in the figure.

Operation of the first embodiment of this invention is as follow.

The screw 2, when revolved by the shaft 4, presses the partition plates 5 to slide along with the longitudinal guide groove 3 in the axial direction of the shaft 4. The partition plates 5 divide the space extending in a spiral in the screw 2, so that each partitioned space moves forward along with the rotation of the screw 2. Each of the partition plates 5 can scrape stuck material off the screw 2. The screw pump can then be free of clogging, assuring secure feed of sticky materials.

Figure 2:
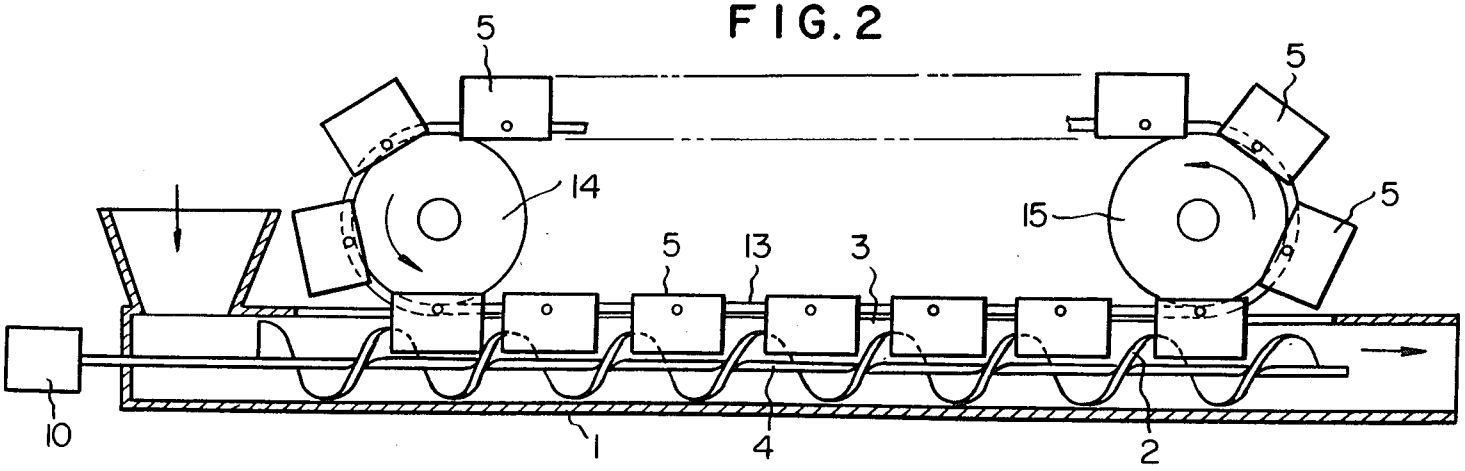
FIG. 2 is a cross-sectional view of a second embodiment of the screw pump according to the present invention.

FIG. 2 shows the second embodiment of the screw pump described above, wherein a longitudinal guide slot 3 is provided in place of the longitudinal guide groove 3 so that the partition plates 5 can project out of the slot. The partition plates 5 are linked with a chain 13 that is engaged with sprocket wheels 14 and 15 so that the partition plates 5 can be fed in an automatically continuous way.

Figure 3A:
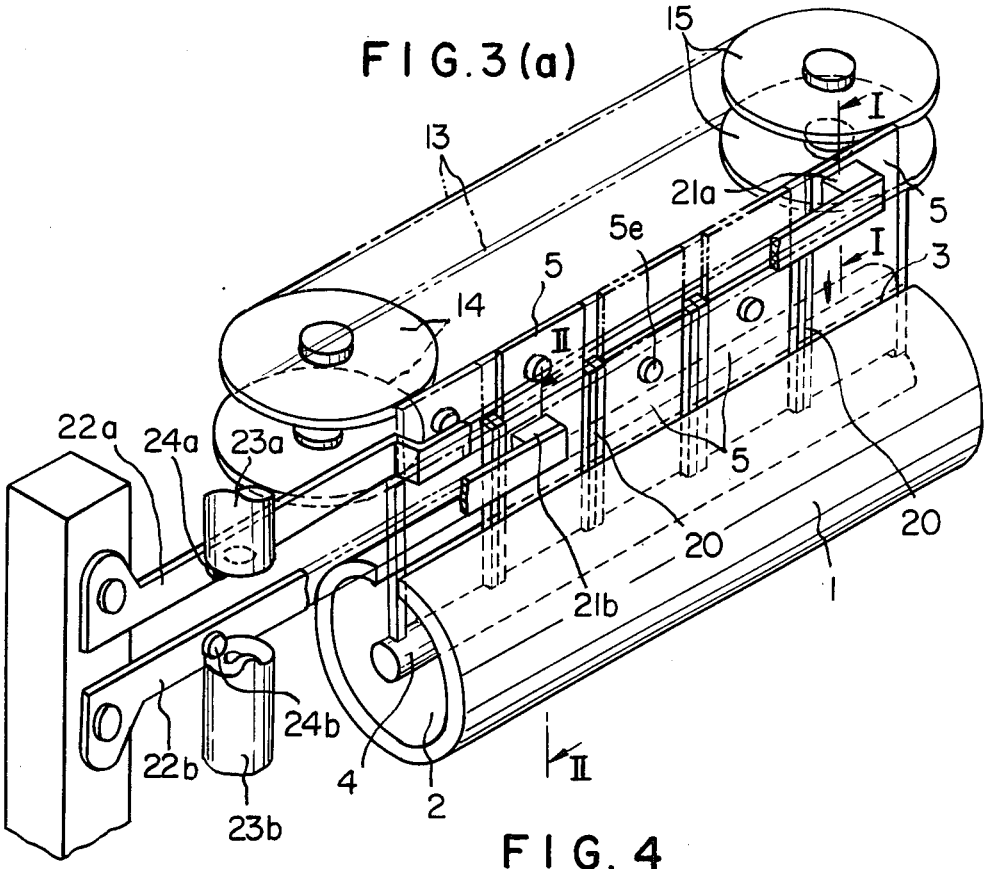
FIG. 3 (*a*) is a perspective view of a third embodiment of the screw pump according to the present invention.
Figure 3B:
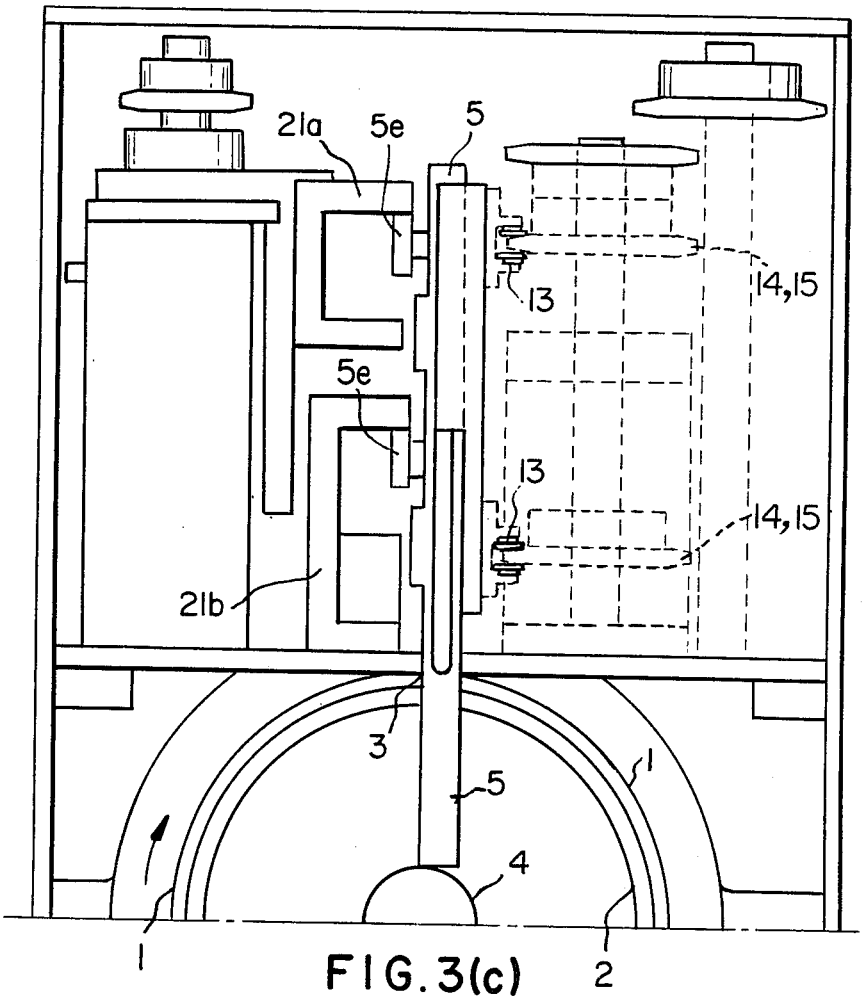
Figure 3C:
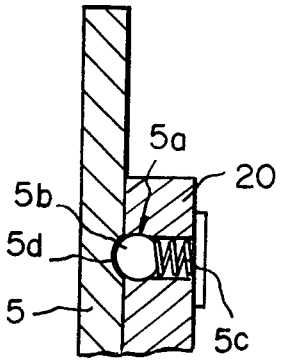

FIGS. 3(*a*), (*b*), and (*c*) show the third embodiment of this invention in which the same numerals are used for same parts as for said previous embodiments and only different parts are explained. The partition plates 5,5, . . . are slidably supported in vertical direction on a vertical holder frame 20,20, . . . respectively and locked at upper position by detent means 5*a*,5*a* . . . , As shown in FIG. 3 (*c*), the detent mean 5*a* consists of a ball 5*b* biased by a spring 5*c* so as to engage with a depression 5*d* of the partition plate 5. The vertical holder frames 20,20 . . . are supported by a pair of upper and lower chain 13,13 which are engaged with upper and lower horizontal sprocket wheels 14,14 and 15,15 respectively. Each partition plate 5,5 . . . has rollers 5*e*,5*e*, . . . which are registered to engage with C-shaped frames 21*a*,21*b* at the ends of a pressing lever 22*a* and an elevating levers 22*b*. These lever 22*a* and 22*b* are actuated downwardly and upwardly by crown cams 23*a* and 23*b* through cam followers 24*a* and 24*b* respectively so as to lower or elevate said partition plates 5,5 . . . at prerdetermined positions respectively.

Said pressing lever 22*a* and elevating lever 22*b* may be substituted by another lowering means and elevating means such as a solenoid, an electro-magnetic actuating means, a pressure fluid cylinder actuating means.

Figure 4:
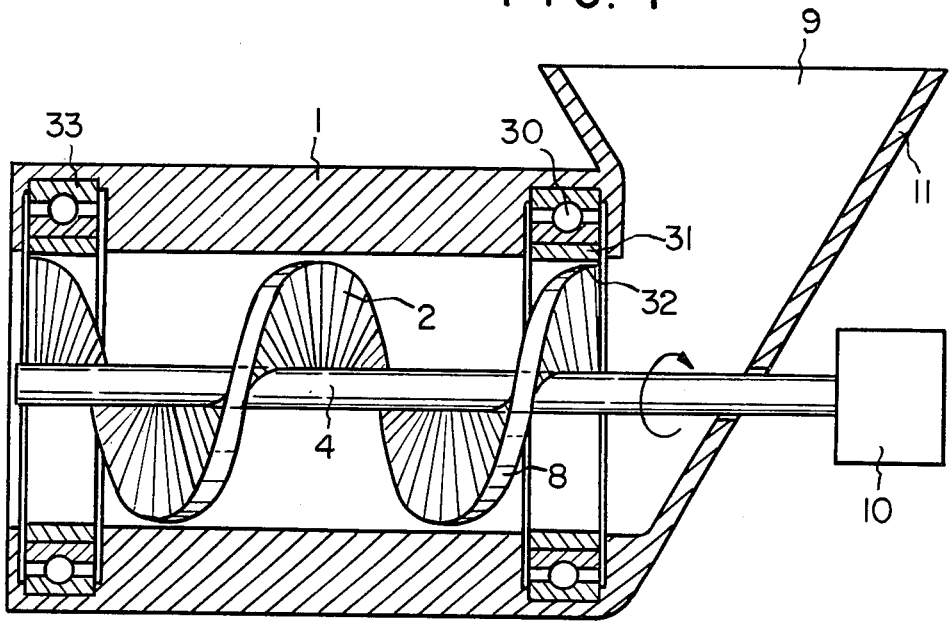
FIG. 4 is a longitudinal cross-sectional view of a fourth embodiment of the pressure feed screw pump according to the present invention.

FIG. 4 shows the fourth embodiment of the present invention for ready mixed concrete and similar materials comprising a pump having an outer cylinder 1, a screw 2 provided to revolve in said outer cylinder 1, a bearing 30 provided at an inlet of said outer cylinder 1, and inner sleeve 31 provided for said bearing 30, and a fixing portion 32 provided at an edge of said screw 2 to secure said inner sleeve 31 to said screw 2.

Operation of the fourth embodiment of this invention is as follow.

The screw 2, when revolved, makes the inner sleeve 31 for the bearing 30 revolve together with the revolving blade of the screw 2. This prevents the ready mixed concrete, the aggregate, or similar foreign materials from being caught between the screw 2 and outer cylinder 1.

Referring to the drawing, the bearing 30 used is a ball bearing, which can be replaced by another type of bearing. The fixing portion 32 is provided by welding. A shaft of the screw 2 is indicated by 4, a driving motor by 10, and an inlet of the ready mixed concrete by 9.

There is provided on the edge of the helically extending revolving edge of the screw 2 an additional seal means 8 of rubber or similar elastic materials which can slide in contact with an inside of the outer cylinder 1. This provides more effective prevention of the aggregate from being caught between the outer cylinder 1 and the edge of the revolving blade of the screw 2. There can be also provided a similar bearing 33 at an outlet of the outer cylinder 1. The inner sleeve 31 can be driven in place of the shaft 4.

I claim:

1. A screw pump comprising:

an outer cylinder having a linear central axis, a cylindrical inner wall, an an axially extending groove in said inner wall, a helical screw extending axially inside said cylinder;

drive means for driving said helical screw;

a plurality of partitioning plates axially slidably fitted in said groove so as to be movable with said helical screw in an axial direction of said shaft and to be restrained against movement in a direction around said axis; and said plurality of partitioning plates constructed and arranged to engage said helical screw and fit between adjacent sections of said helix whereby to move axially and not rotatably when the screw is rotated around its axis;

whereby adjacent revolving helical sections are partitioned from each other by said plates to prevent clogging of said pump.

2. The screw pump according to claim 1 in which an entrance hole is provided through the wall of the cylinder at one end of said groove and an exit hole at the other end of said groove; said partitioning plate being insertable into said continuous groove in said outer cylinder through said entrance hole for advancement through said outer cylinder and removable through said exit hole.

3. The screw pump according to claim 2 in which said plurality of partitioning plates are mounted on a revolving chain.

4. The screw pump according to claim 1 in which said groove comprises a slot through said wall extending along substantially its entire length; and conveyor means feeding said plurality of partitioning plates through said slot into said outer cylinder between adjacent sections of said helical screw for advancement with said helical screw.

5. The screw pump according to claim 1 in which said outer cylinder has a longitudinal slot; support means vertically supporting said plurality of partitioning plates in said longitudinal slot; said support means constructed and arranged to sequentially lower said plurality of partition plates into said outer cylinder between adjacent helical sections of said screw, advance said plurality of partition plates and raise said plurality of partitioning plates near the end of said longitudinal slot.

* * * * *